United States Patent [19]

Capdebosc

[11] Patent Number: 4,711,172

[45] Date of Patent: Dec. 8, 1987

[54] MACHINE HAVING A PLURALITY OF WORKING STATIONS FOR SUCCESSIVELY PROCESSING A SHEET OF MATERIAL RUNNING THROUGH THE MACHINE

[75] Inventor: Bernard Capdebosc, Saint Just Chaleyssin, France

[73] Assignee: Martin S.A., Villeurbanne, France

[21] Appl. No.: 890,836

[22] Filed: Jul. 25, 1986

[30] Foreign Application Priority Data

Jul. 26, 1985 [FR] France ..... 85 11655

[51] Int. Cl.[4] ..... B41F 9/02

[52] U.S. Cl. ..... 101/152; 101/183; 101/216; 101/232; 101/DIG. 10

[58] Field of Search ..... 101/152, 180–181, 101/183–184, 174, 216, 219, 221, 225, 228, 232, 136–145, DIG. 10

[56] References Cited

U.S. PATENT DOCUMENTS

| | | | |
|---|---|---|---|
| 2,425,680 | 8/1947 | Kaddeland | 101/152 X |
| 2,542,867 | 2/1951 | Harrold | 101/137 |
| 3,329,087 | 7/1967 | Sandor et al. | 101/181 |
| 3,472,161 | 10/1969 | Farrer | 101/181 |
| 3,625,145 | 12/1971 | Heatley, Jr. et al. | 101/152 |
| 3,835,776 | 9/1974 | Weidman | 101/183 |
| 4,332,579 | 6/1982 | Johnson | 493/325 |
| 4,393,772 | 7/1983 | Burger | 101/228 |
| 4,449,450 | 5/1984 | Barny et al. | 101/216 |
| 4,471,693 | 9/1984 | Tsukasaki | 101/183 |
| 4,531,929 | 7/1985 | Schwardt | 101/183 X |
| 4,616,564 | 10/1986 | Faddis et al. | 101/143 |

FOREIGN PATENT DOCUMENTS

| | | | |
|---|---|---|---|
| 480175 | 12/1969 | Switzerland | 101/152 |
| 1057456 | 2/1967 | United Kingdom | 101/152 |

*Primary Examiner*—E. H. Eickholt

*Attorney, Agent, or Firm*—Hill, Van Santen, Steadman & Simpson

[57] ABSTRACT

In a machine for successively processing cardboard sheets running through a printing machine having more than one printing station, the active parts of each of the printing stations being mounted on a vertical slide in the machine frame with an arrangement for lifting the parts from a working position to either a standby or a preparatory position with the printing cylinder of each station being out of engagement with the sheet being carried by a conveyor arrangement through the machine. This will allow easy access to the printing cylinder. The machine includes a shiftable guide or shutter, which can be moved to a position beneath the printing cylinder when the cylinder is raised from the working position to guide the sheet passing through the station which is not in a working mode.

10 Claims, 8 Drawing Figures

MACHINE HAVING A PLURALITY OF WORKING STATIONS FOR SUCCESSIVELY PROCESSING A SHEET OF MATERIAL RUNNING THROUGH THE MACHINE

BACKGROUND OF THE INVENTION

The present invention is directed to a machine or apparatus for successively processing cardboard sheets passing through a machine, particularly a printing machine or press. This machine or apparatus will have a main conveyor which is made up of a suction belt and extends between an input and output of the machine, a plurality of printing or working stations each having one blanket cylinder mounted on an active part of the station and one counter printing cylinder arranged on a vertically geometrical axis of the blanket cylinder beneath the suction belt and a pressure roller at the input of the machine and at the output.

Generally, the machines for processing cardboard sheets, particularly printing machines, comprise several printing stations or groups following each other. The U.S. Pat. No. 4,531,929, whose disclosure is incorporated by reference, describes such a machine for processing sheets conveyed through several successive stations. U.S. Pat. No. 4,332,579, whose disclosure is incorporated by reference, also discloses a similar type machine. Both the machines or apparatuses described in these two applications refer to printing or cutting stations lifted or lowered from a working position to an out-of-order or withdrawn position. Moreover, the various successive stations are not immediately following each other but are always separated by a space allowing the passage of the operator between each processing group or station. This arrangement increases the length of the machine and hinders an easy and quick setting of the various stations since access of the operator to these stations is only allowed from one point in the machine. Thus, due to the arrangement of the various stations, the operator can only work on the spare space left between the stations.

SUMMARY OF THE INVENTION

The present invention is intended to simplify the arrangement of the various stations in order to overcome the above mentioned drawbacks as well as to reduce the unproductive time devoted to the setting up of a station.

To accomplish these goals, the present invention is directed to an improvement in a machine for successively processing cardboard sheets running through a machine, particularly a printing machine, which machine comprises a main frame, conveyor means having a suction belt extending between an inlet and outlet, printing stations disposed along the path of the belt with each printing station having a blanket or printing cylinder mounted on an active part of the station and one counter printing cylinder or roll arranged in a vertically geometric axis of the blanket cylinder beneath the suction belt and a pressure cylinder or roll at the input and outlet of the machine. The improvements are that the printing stations are arranged by pairs cooperating and separated from each other by a crossing or transverse foot bridge, the active part of each of the printing stations includes the blanket cylinder are mounted in a slide arranged in the frame, lifting means engaging each of the slides for lifting the printing station from a working position to a waiting or standby position to a preparative position, said station while in said preparative position being accessible from the foot bridge, the vertical position of the counter printing cylinder of each station being arranged beneath the suction belt an remaining unchanged during the vertical shifting of the movable portion of the station and the machine comprises means insuring the guiding of the upper part of a sheet at each printing station when the printing station is in any position other than a working position.

Further advantages and improvements of the present invention will be readily apparent from the following description, claims and drawings.

Figure 4:
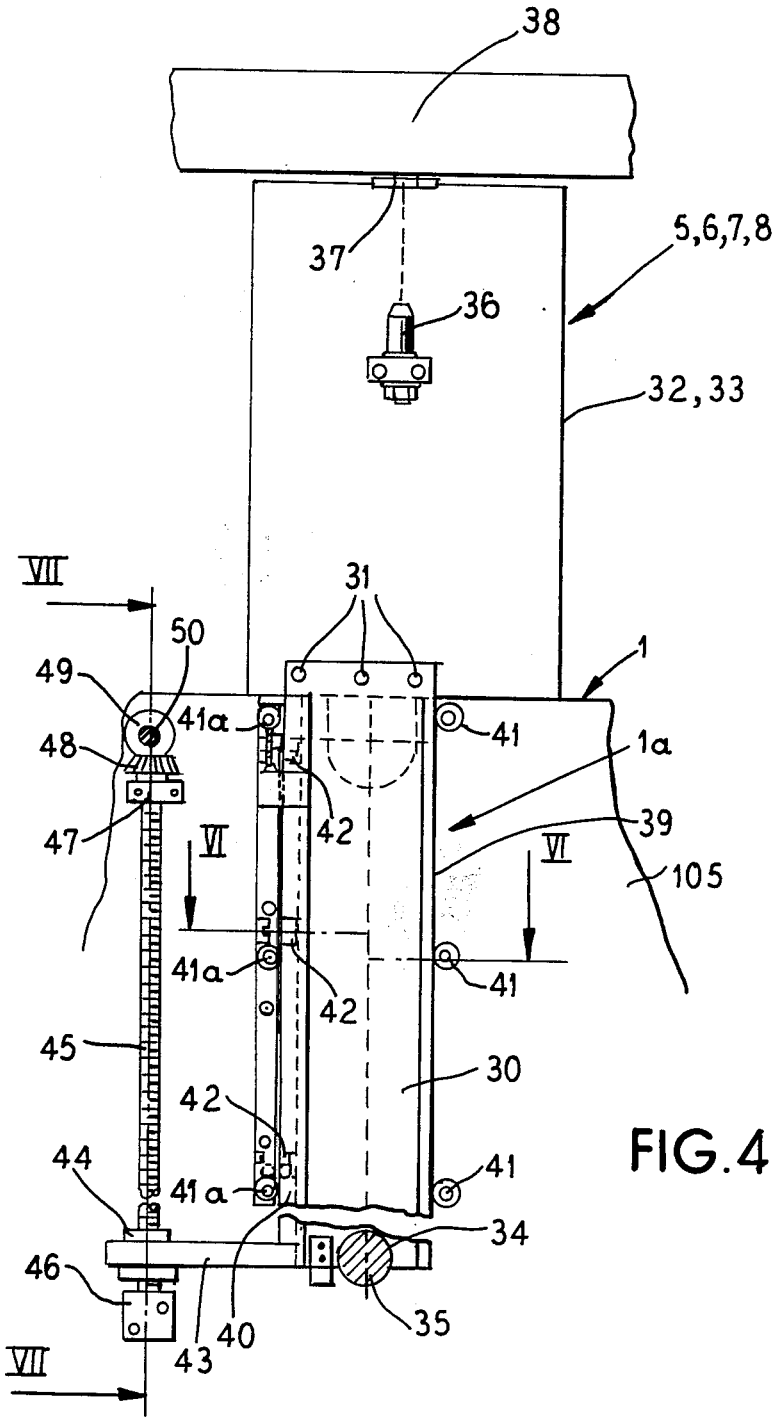
FIG. 4 is a partial side view with portions broken away for purposes of illustration of a guiding and shifting device for a printing station.

FIGS. *7a* and *7b* are cross sectional views taken along lines VII—VII of FIG. 4 with FIG. *7a* being a right hand side of the frame with the station in the lowermost position and FIG. *7b* being the left hand side with the station in the uppermost position.

DESCRIPTION OF THE PREFERRED EMBODIMENTS

Figure 1:
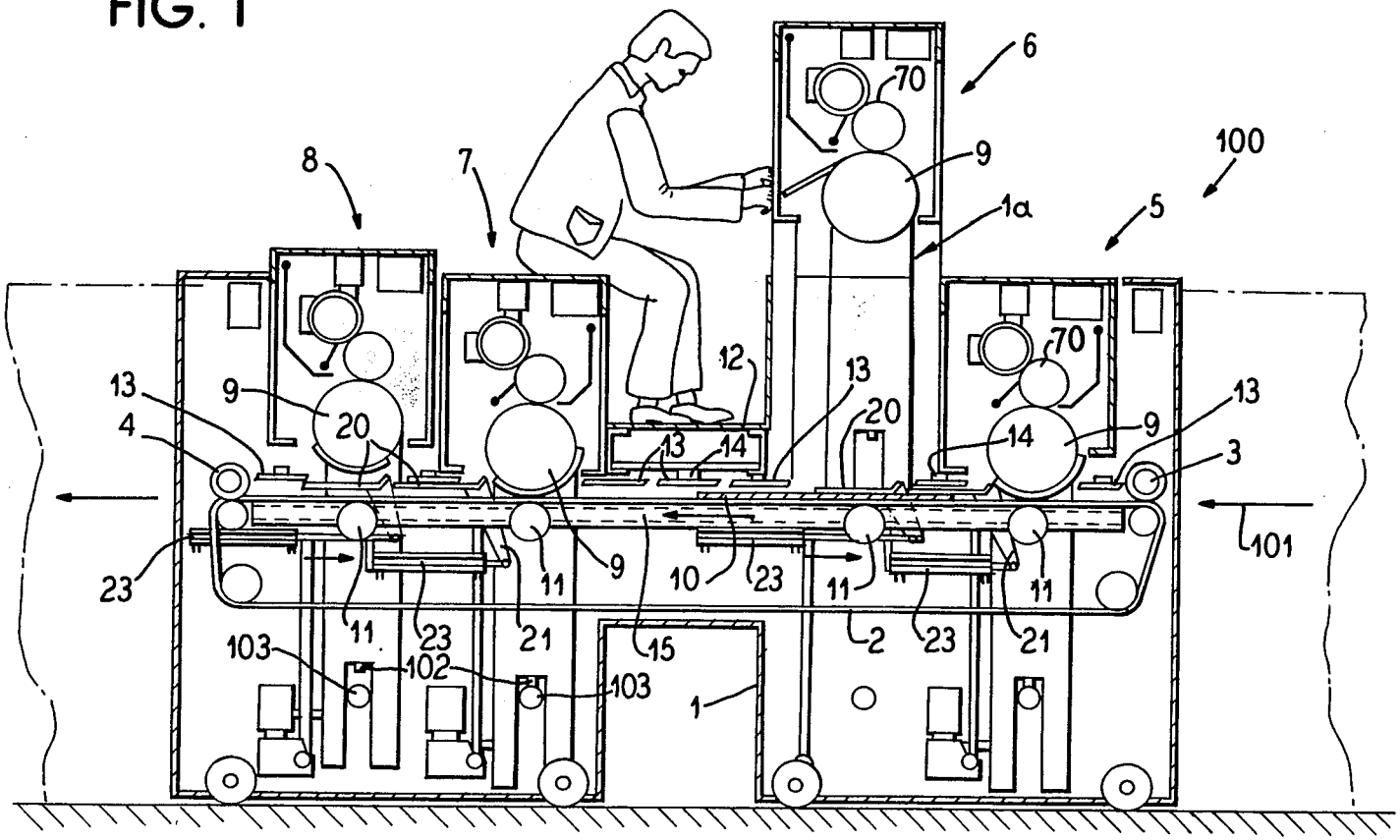
FIG. 1 is a longitudinal cross sectional view with portions in elevation of a machine according to the present invention.

The principles of the present invention are particularly useful when incorporated into an apparatus or machine generally indicated at 100 and illustrated in FIG. 1. The apparatus or machine 100 includes a frame 1 with a main conveyor including a suction means for transporting a sheet of material in the directions of the arrows 101 from right to left as illustrated in FIG. 1. The main conveyor means includes a suction belt 2 which cooperates with a pressure roller 3 at an input of the machine and also with a pressure roller 4 at an output or discharge end of the machine. Between the rollers 3 and 4 are four identical stations, generally indicated at 5, 6, 7 and 8, which are arranged in two separate pairs with the pairs being separated by a transverse foot bridge 12. Each of the stations 5, 6, 7 and 8 include a printing cylinder 9, such as a blanket cylinder, which cooperates with a counter printing cylinder 11 which is positioned beneath the suction belt 2 on a geometrical vertical axis of the blanket cylinder 9 so that a sheet 10 being conveyed along the suction belt 2 will be urged against the printing cylinder 9 as it passes through each printing station. Each of the stations 5–8 in addition to the printing cylinder 9, includes inking devices or cylinders 70 which are not described or illustrated in greater detail.

According to the present invention, the active parts of each printing station 5, 6, 7 and 8, such as the blanket or printing cylinder 9 and printing device 70 are mounted in a sub frame which is mounted on a vertical slide 1*a* for movement in the frame 1 so that the printing group of the particular station, whic includes the plates that are to be changed, can be raised from a printing or working position as illustrated by the stations 5 and 7 to a standby position as illustrated by the printing roll 9 of the station 8 to a preparative position illustrated by the station 6. If either a mono or single color printing or only a bi-color printing is required, all four of the stations are not required and the printing stations, which are not required, can be raised to a standby position, such as illustrated by the station 8, so that their printing cylinder 9 and the plates carried thereon will not touch the sheet passing therebeneath. As illustrated in FIG. 1, the station can also be raised to an out-of-order or preparative position to allow an operator positioned on the catwalk or foot bridge 12 to make changes in the printing plates carried by the cylinder 9.

Figure 2:
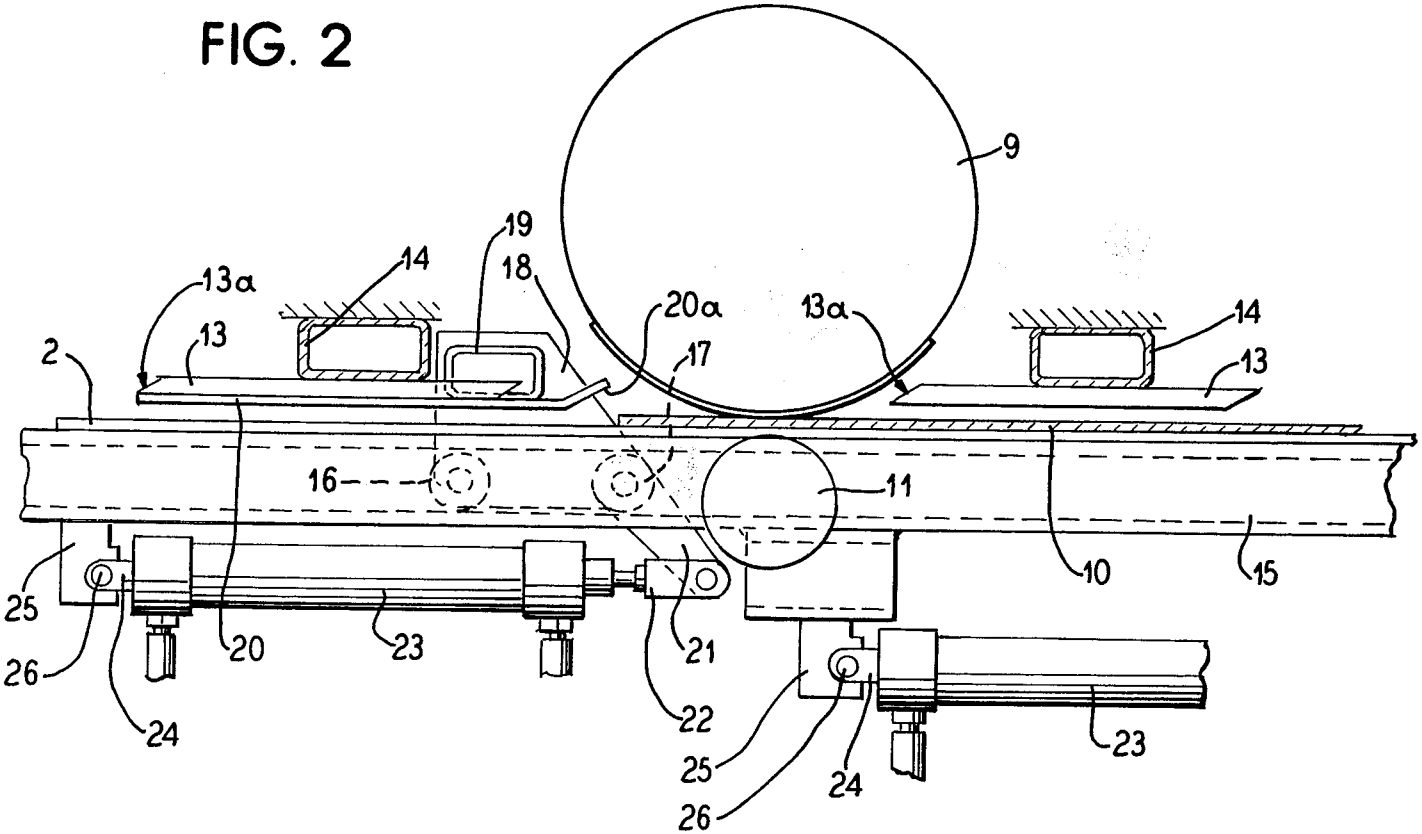
FIG. 2 is an enlarged and detailed cross sectional view of a fixed guide on both sides of a printing station and of the shiftable guide in a retracted position.

Adjacent each of the stations or printing groups, the frame includes horizontal guides 13 which are connected on cross bars 14 (FIG. 2). These guides are made of spaced bars to overcome a suction difficulty and help guide the cardboard sheet which could be slightly skewed as it passes beneath the pressure roll 3 at the input of the machine or between the counter printing cylinder 11 and printing cylinder 9 of the previous station. Thus, a correct, flat running of succesive sheets in each group is insured.

Figure 3:
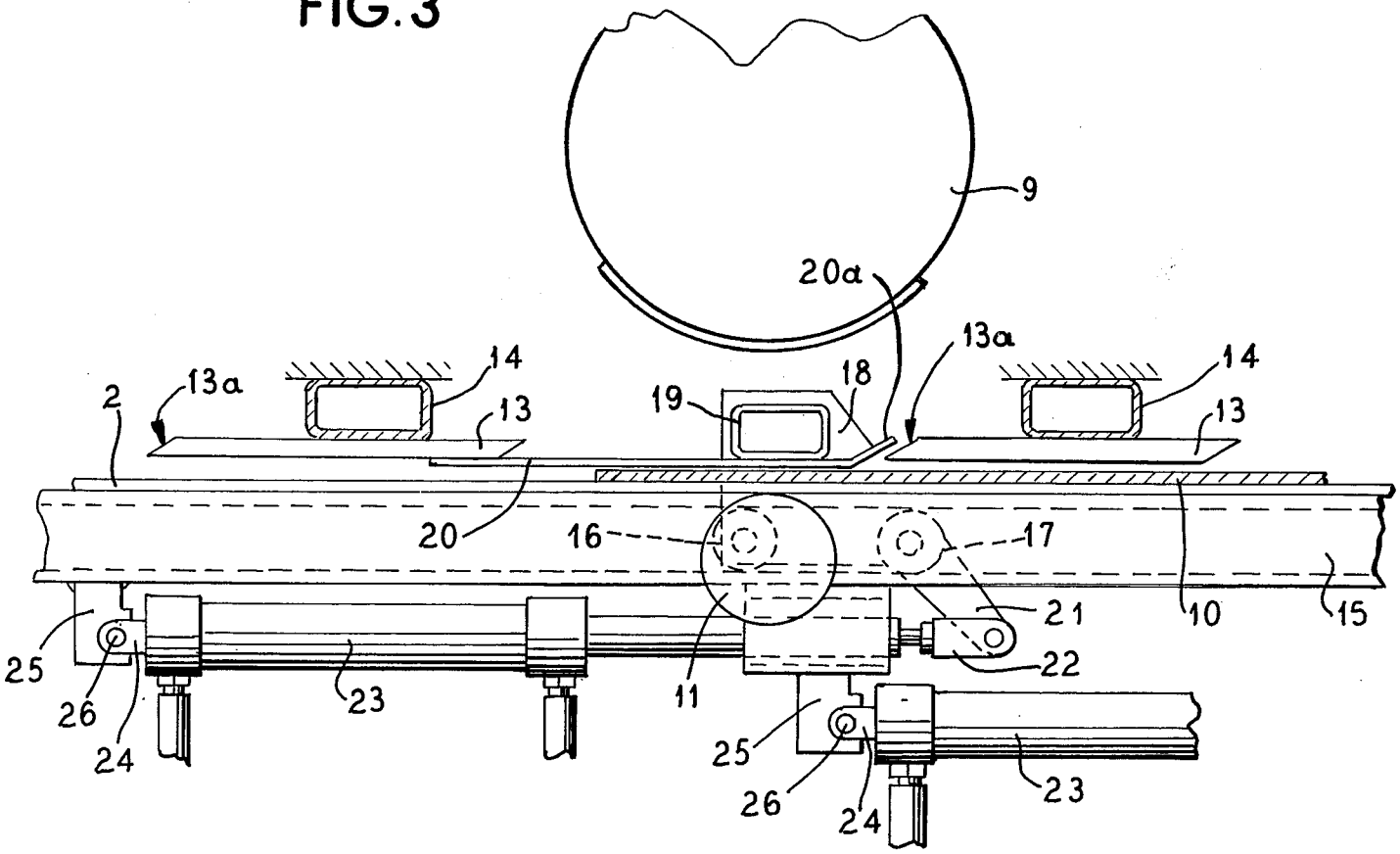
FIG. 3 is an enlarged cross sectional view similar to FIG. 2 with the shiftable guide in a working position and the printing roll or cylinder in a raised position.

When the printing cylinder 9 is lifted from its working position to a standby position, such as illustrated by the station 8 of FIG. 1 and by the cylinder 9 in FIG. 3, or to a preparative position, such as illustrated by the station 6 of FIG. 1, an upper guiding of the sheet is required to insure the accurate running of the sheet through this station which is no longer in the working position or mode. To accomplish this, the frame 1 is provided with two longitudinally extending slides 15 which are arranged on both sides of the belt 2 and provide a rolling path for two rollers 16 and 17 (FIGS. 2 and 3) which are mounted for rotation on two plates 18 which are interconnected by a cross bar 19. This arrangement constitutes a carriage which is shiftable along the direction of movement of the belt 2 in the frame 1. On its bottom the cross bar 19 is provided with a horizontal shutter or plate 20 with an up side cambered rear edge 20*a*. One plate 18 of the carriage is connected by a small rod or link 21 to a link or strap 22 provided on an end of a piston rod of a hydraulic cylinder or jack 23. The bottom of the cylinder is provided with two cheeks 24 connected by an axle or pin 26 to a bracket 25 that extends from the bottom of the slide 15. The shutter 20 is mounted against the lower face of one of the fixed guides 13 (FIG. 2).

When the printing cylinder 9 is lifted and does not provide any guiding function to the cardboard sheet running along the belt 2, the jack or cylinder 23 is actuated in such a way that the shutter 20 shifts to extend between the two fixed guides on both sides of the cylinder 9 as shown in FIG. 3. The lifted rear edge 20*a* of the shutter will cooperate with a slanted edge 13*a* of the corresponding upstream guide 13 while its front edge remains against the downstream guide 13. Thus, the constant upper guiding of the cardboard sheet carried by the belt 2 will be achieved. The height of all of the jacks or cylinders 23 is relative to the slider 15 so that the jacks driving the shutter 20 can be positioned even if the printing groups are close to each other. The jacks 23 are actuated separately or can be actuated in synchronism with the upstroke of the corresponding station. For example, a sensor 102 engages a member 103 when the station is in the working position and mode as shown at station 7 (FIG. 1). If the station is lifted from the working position, the sensor 102 disengages the member 103 and the disengagement can be used to create a contact signal to actuate the jack to move the plate 20 to the closing position of FIG. 3.

Figure 5:
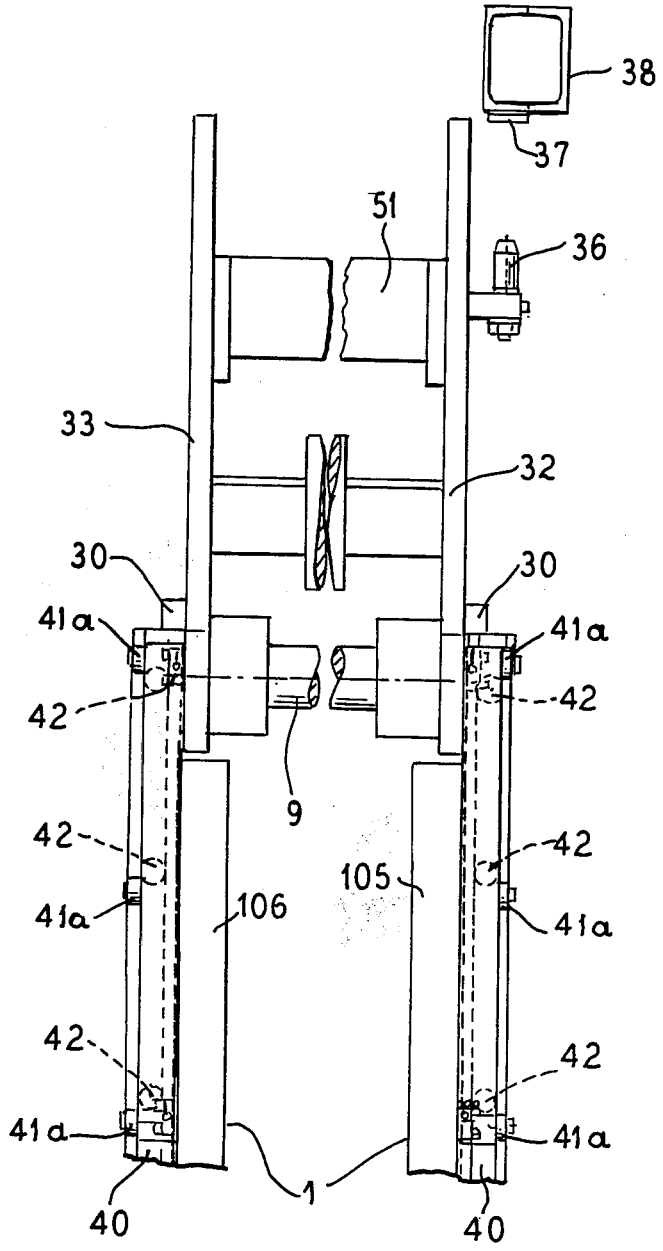
FIG. 5 is a left end view of a printing station of FIG. 4.

Referring to FIGS. 4 and 5, the frame 1 has a pair of spaced apart side members 105, 106 and each of the printing groups or stations 5, 6, 7 and 8 have a pair of side frames or elements 32 and 33, which as illustrated in FIG. 5 are spaced apart by a cross piece or member 51. As also illustrated in FIG. 5, the printing cylinder 9 is mounted to extend between the side elements 32 and 33 and for rotation.

To raise and lower each of the stations 5, 6, 7 and 8, vertical slides 1*a* are provided and include one slider 30 which is fastened by screws 31 against the outer face of each of the side frames of the printing station as best illustrated in FIG. 4. On a lower part of the slider 30 a half bore or a notch 34 is provided for receiving a round cross bar 35 for centering the printing station or machine when it is in the working position. In a standby position, the printing station is centered simply by being guided by the slides 1*a*. In the preparative or changing position, the printing station is locked in a center mode by a pin 36 which is mounted on the side frame 32 and is engaged in a hole or aperture 37 in an upper bar or member 38 (FIGS. 4 and 5).

To guide the slide 30 as it moves between its various positions, the slide has two members 39 and 40 which provide guide surfaces for rollers, such as first roller 42, third roller 41 and second roller 41*a*, which are mounted on the main frame 1. The slide at the lower end is also provided with an arm 43 which has a threaded member or nut 44 received on a lifting screw or jack 45. The jack or screw 45 is mounted on the side member 105 at a lower end by a stop or bearing 46 and is supported on an upper end by a bearing 47 and has a bevel pinion 48 that engages another bevel pinion 49 which is secured on a cross shaft 50. The construction of the bearing and the shafts will be discussed in greater detail with regard to FIG. 7.

As illustrated in FIG. 5, the two side frame elements 32 and 33 are spaced apart the desired distance by a cross member 51 which is positioned adjacent the upper area. The lower portions of these two frame elements which are secured to the sliders 30 are held in a desired spacing due to the first rollers 42 being guided by roller paths in the first member 40 which is attached to each slider 30.

Figure 6:
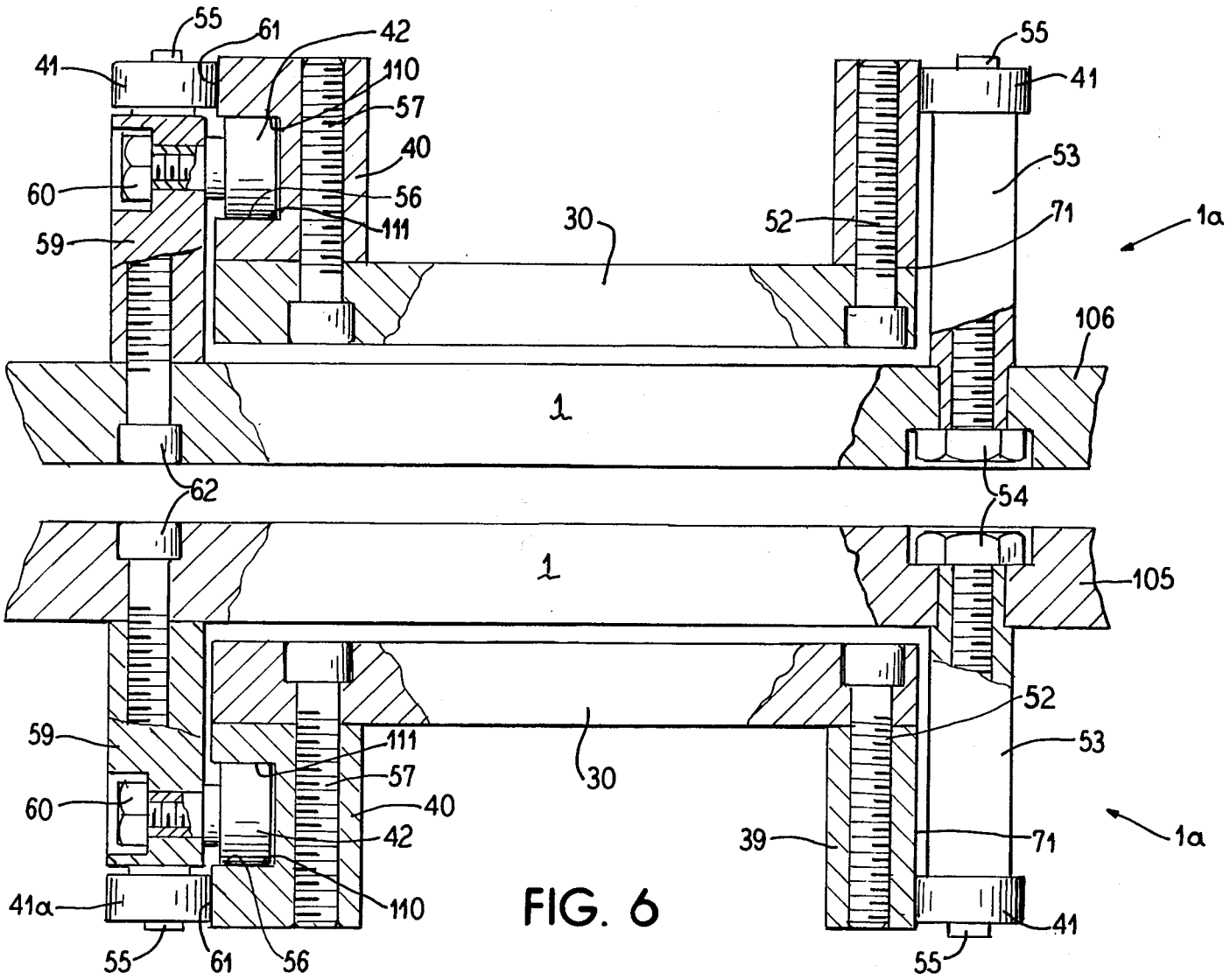
FIG. 6 is a cross sectional view taken along lines VI—VI of FIG. 4.

Referring to FIG. 6, it is easily seen that the second member 39 is held by screws 52 onto the slide 30 and has a surface 71 which forms a third roller path for the third rollers 41 which are in turn mounted by cross pieces or members 53 which are secured by screws 54 on an outer face of the frame members 105, 106 of the frame 1. The third roller 41 is connected to the cross piece 53 with the help of an axle 55 which has a ball bearing (not illustrated) to provide a rotational support for the roller. The first member 40 is made of a bar with a groove 56 which provides spaced apart, parallel extending roller paths 110, 111 and also has a second roller path 61. The first member 40 is secured onto the slide 30 by screws 57. A support 59 is secured on the side members 105, 106 by machine screws 62 and has second rollers 41*a* rotatably mounted on axles 55 which rollers 41*a* engage the second roller path 61. Inward of the rollers 41 are first rollers 42, which are also mounted on ball bearings and are secured by means of machine screws 60. The rollers 42 have a diameter that is slightly less than the spacing between the two parallel extending roller paths 110 and 111 formed by the groove 56 and thus, provide lateral guidance to limit movement of the slide 30 in a first direction perpendicular to the plane of the members 105, 106 of the main frame 1. The roller 41, 41*a* and surface 61 and 71 coact to limit movement in a second direction extending parallel to the members 105, 106 and perpendicular to the first direction.

Figures 7A, 7B:
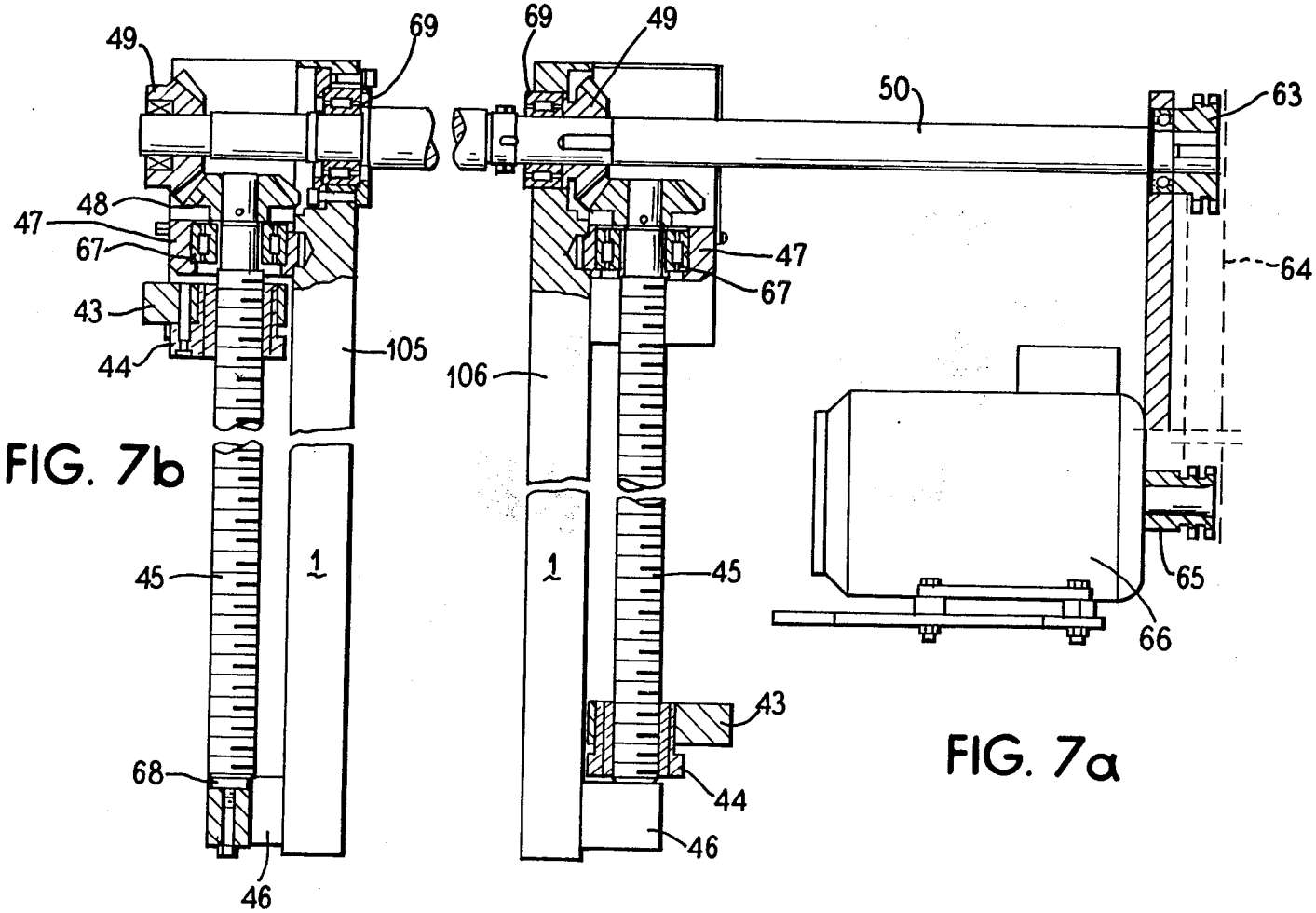

The means for lifting each of the slides 30 is illustrated in FIGS. 4 and 7. As mentioned hereinabove, the arm 43 receives the threaded bearing or nut 44 which is received on a threaded shaft 45. In FIG. 7*a*, the arm 43 is shown in the lowermost position whereas in FIG. 7*b*, it is shown in the uppermost position. Thus, when the arm reaches the position as illustrated in FIG. 7*b*, the printing unit or station will be in the preparative or withdrawn position. The arm for each of the sliders 30 move in unison because both of the screws 45 turn together due to the beveled pinions 48 keyed to the screws 45 engaging the bevel pinions 49 keyed to the transverse shaft 50. The shaft 50 is also provide on one end with a duplex chain gear 63 connected by a chain 64 (shown in dotted lines) to a duplex pinion 65 on a shaft of a DC motor 66 which will be utilized to raise and lower the printing group. As illustrated, each of the drive screws 45 is guided in a bearing 47 which has a roller bearing 67 adjacent the upper end while the transverse shaft 50 is supported by roller bearings 69 in the frame members 105, 106 of the frame 1. The lower end of each screw 45 is held vertically in a stop 46 which may be provided with thrust bearings such as 68. Thus, with the means for lifting or lowering the printing group, the active part of each station can be shifted vertically. The active part of the printing group includes the printing cylinder 9 and its inking device 70. When this active part is lifted, the counter roller or cylinder 11, which is in the static part of the printing group, will never achieve any vertical shifting.

Thanks to the arrangement by pairs of the printing group 5, 6, 7 and 8, the operator can get to any separate group from one single place located between the pair of printing groups as illustrated in FIG. 1. This characteristic notably reduces the time required for preparing the printing stations and facilitates the job of the machine operator. Moreover, this arrangement does not require, as other constructions do, a space occupying foot bridge all along the upper part of the machine.

Although various minor modifications may be suggested by those versed in the art, it should be understood that I wish to embody with the scope of the patent granted hereon, all such modifications as reasonably and properly come within the scope of our contribution to the art.

I claim:

1. In a machine for successively processing cardboard sheets running through a machine having a plurality of printing stations, said machine including a main frame having main conveyor means extending from an inlet to an outlet including a suction belt, a pressure cylinder acting on the belt at the inlet and a pressure cylinder acting on the belt at the outlet, a plurality of printing stations being mounted along the suction belt of the conveyor means with each printing station having one printing cylinder mounted in an active part of the station and a counter cylinder mounted in the frame below the suction belt to cooperate with the printing cylinder, the improvements comprising the printing stations being arranged in pairs with a transverse foot bridge extending between two pairs of printing stations, the active parts including the printing cylinder of each printing station being mounted on slides for movement in a vertical direction on the frame, lifting means for each station for moving the slides in a vertical direction to shift the printing cylinder between a working position for engaging a sheet carried by said suction belt through a standby position with the cylinder out of engagement with a sheet on said belt to a preparative position enabling a worker standing on the foot bridge to gain access to the active parts of the printing station, the counter cylinders of each station being fixed in a permanent and unchanged vertical position during movement of the printing cylinder in the vertical direction, and means for insuring the guiding of the upper surface of a sheet through the printing station while said printing station is in one of the standby and preparative positions.

2. In a machine according to claim 1, wherein each of the printing stations has a pair of lateral frame elements, said slide includes a slider secured to each of said lateral frame element, said main frame having a pair of lateral spaced side members having guide means including roller paths and coacting rollers for guiding the slide as it moves between the vertical positions.

3. In a machine according to claim 2, wherein the guide means includes a first guide member having a groove forming a pair of parallel and spaced apart guide surfaces with one of the pair of surfaces receiving first rollers inserted into said groove to provide guiding in a first direction extending perpendicular to the plane of the side members of the frame, said first guide member having a second roller path extending at right angles to the pair of parallel paths for receiving second rollers to guide in a direction perpendicular to said first direction, a second guide member providing a third roller path extending parallel to the second roller path for receiving third rollers to coact with the second rollers.

4. In a machine according to claim 1, wherein the frame has a pair of spaced apart side members, said lifting means includes a pair of vertically oriented screws mounted on the side members for rotation, means for simultaneously rotating said screws, a threaded nut on each of said screws being connected to an arm of the slides for the printing station so that rotation of said vertical screws vertically shifts the nut along the axis of said screws to vertically shift the slides.

5. In a machine according to claim 4, wherein the means for rotating includes a shaft mounted transverse to the frame to extend between the side members, said shaft having bevel pinions coacting with bevel pinions on each of said screws, and drive means connected to rotate said shaft.

6. In a machine according to claim 1, which includes fixed guides positioned adjacent the upper surface of the suction belt to facilitate guiding the sheets on the belt as it moves between each of the printing stations.

7. In a machine according to claim 6, which includes a shiftable guide for each station, said shiftable guide being movable from a position beneath a fixed guide to a position extending between two fixed guides and beneath a raised printing cylinder when the printing station is in one of the raised positions to guide the sheet through the station.

8. In a machine according to claim 7, wherein the shiftable guide is secured on a cross bar of a carriage mounted for movement along two longitudinal slides.

9. In a machine according to claim 8, wherein the carriage includes a pair of side plates secured to the end of said cross bar, each of said side plates supporting a pair of rollers received in the longitudinal sides and each carriage is shifted between the two positions by a fluid actuated jack.

10. In a machine according to claim 9, wherein the fluid actuated jack is actuated in sychronism with the lifting means of the printing station so that the shiftable guide is shifted to a position beneath the printing cylinder as the printing cylinder is shifted above the working position.

* * * * *